US012471750B2

(12) United States Patent
Agrawal

(10) Patent No.: US 12,471,750 B2
(45) Date of Patent: Nov. 18, 2025

(54) ADJUSTABLE RACK ASSEMBLY OF A DISHWASHER APPLIANCE

(71) Applicant: Haier US Appliance Solutions, Inc., Wilmington, DE (US)

(72) Inventor: Abhisek Agrawal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 258 days.

(21) Appl. No.: 18/360,986

(22) Filed: Jul. 28, 2023

(65) Prior Publication Data

US 2025/0031940 A1 Jan. 30, 2025

(51) Int. Cl.
*A47L 15/50* (2006.01)

(52) U.S. Cl.
CPC ..... *A47L 15/504* (2013.01)

(58) Field of Classification Search
CPC ..... A47L 15/50; A47L 15/501; A47L 15/504; A47L 15/506; A47L 15/507
See application file for complete search history.

(56) References Cited

U.S. PATENT DOCUMENTS 5,474,378 A * 12/1995 Smith ..... A47L 15/507 D15/19
5,595,200 A * 1/1997 Favaro ..... A47L 15/504 134/201
5,860,716 A * 1/1999 Good ..... A47L 15/504 312/351
6,974,040 B2 * 12/2005 Jahrling ..... A47L 15/504 211/175
7,168,578 B2 * 1/2007 Mersch ..... A47L 15/504 211/41.9
7,410,228 B2 * 8/2008 Dickson ..... A47L 15/504 312/351
7,418,967 B2 * 9/2008 Kim ..... A47L 15/504 312/351
7,651,180 B2 * 1/2010 Deiss ..... A47L 15/504 312/351
7,775,378 B2 * 8/2010 Tynes ..... A47L 15/504 211/41.8
8,192,557 B2 * 6/2012 Ryu ..... A47L 15/504 134/147
8,534,471 B2 * 9/2013 Wong ..... A47L 15/504 312/351
8,567,882 B1 10/2013 Garnett
8,813,766 B2 * 8/2014 Bhajak ..... A47L 15/4246 134/135
9,004,082 B2 * 4/2015 Bhajak ..... A47L 15/504 134/135
(Continued)

FOREIGN PATENT DOCUMENTS

CH 690488 A5 9/2000

*Primary Examiner* — Patrick D Hawn
(74) *Attorney, Agent, or Firm* — Dority & Manning, P.A.

(57) ABSTRACT

A dishwasher appliance may include an adjustable rack assembly. The adjustable rack assembly may include a side wall and may be transitionable between an upper position and a lower position along the vertical direction. In addition, the dishwasher appliance may include a bracket assembly that may be attached to the side wall. Further, the bracket assembly may include a rack mount and a lever. The rack mount may include a top portion. The lever may be hingeably coupled to the rack mount at the top portion.

17 Claims, 8 Drawing Sheets

(56) References Cited

U.S. PATENT DOCUMENTS

| | | | | |
|---|---|---|---|---|
| 9,579,009 | B2 * | 2/2017 | Bhajak | A47L 15/504 |
| 9,763,557 | B2 * | 9/2017 | Kim | A47L 15/507 |
| 10,022,037 | B2 * | 7/2018 | Kutto | A47L 15/502 |
| 10,136,795 | B2 * | 11/2018 | Nowell, Jr. | A47L 15/507 |
| 10,383,506 | B2 * | 8/2019 | Minniti | A47L 15/504 |
| 10,582,829 | B2 * | 3/2020 | Hansen | A47L 15/4293 |
| 10,595,707 | B2 * | 3/2020 | Singhal | A47B 88/493 |
| 10,765,293 | B2 * | 9/2020 | Hansen | A47L 15/46 |
| 10,820,783 | B2 * | 11/2020 | Lam | A47L 15/507 |
| 11,369,250 | B2 | 6/2022 | Lam et al. | |
| 11,445,887 | B2 * | 9/2022 | Singhal | A47L 15/507 |
| 11,559,185 | B2 * | 1/2023 | Elkhoury | A47L 15/507 |
| 11,759,088 | B2 * | 9/2023 | Tütek | A47L 15/504 211/41.8 |
| 12,185,894 | B2 * | 1/2025 | Garnett | A47L 15/504 |
| 2005/0039782 | A1 * | 2/2005 | Kim | A47L 15/504 134/137 |
| 2011/0018410 | A1 | 1/2011 | Bastuji et al. | |

* cited by examiner

ADJUSTABLE RACK ASSEMBLY OF A DISHWASHER APPLIANCE

FIELD

The present subject matter relates generally to dishwasher appliances, and more particularly to bracket assemblies for an adjustable rack assembly of a dishwasher appliances.

BACKGROUND

Dishwasher appliances may have one or more rack assemblies that may be slidably mounted within the dishwasher appliance. The one or more rack assemblies may hold articles, e.g., dishes, cookware, silverware, etc., that may be loaded into the rack assemblies for cleaning. In some instances, the size and shape of the articles held within the rack assemblies may vary significantly. For example, drinking glasses that may be held within the rack assemblies may have different heights, dishes, e.g., plates and bowls, which may be held within the rack assemblies may have various diameters, and pots that may be held within the rack assemblies may have different depths.

In such instances, bracket assemblies may be used to adjust the vertical height of the rack assemblies, e.g., to accommodate the varying size and shape of articles held within the rack assemblies. However, these bracket assemblies may often be difficult for a user to locate and/or use, e.g., due to tight spatial conditions within the dishwasher appliance.

Accordingly, a dishwasher appliance that includes bracket assemblies that may adjust the vertical position of an adjustable rack assembly and may improve the usability and assembly of the adjustable rack assembly would be useful.

BRIEF DESCRIPTION

Aspects and advantages of the invention will be set forth in part in the following description, or may be apparent from the description, or may be learned through practice of the invention.

In one exemplary embodiment, a dishwasher appliance is provided. The dishwasher appliance defines a vertical direction, a lateral direction, and a transverse direction. The vertical, lateral, and transverse direction are mutually perpendicular. The dishwasher appliance includes a tub that defines a wash chamber. The dishwasher appliance also includes an adjustable rack assembly mounted within the tub. The adjustable rack assembly is transitionable between one or more predetermined positions along the vertical direction. The adjustable rack assembly includes a dishrack that includes a side wall. The adjustable rack assembly also includes a bracket assembly attached to the side wall. The bracket assembly includes a rack mount and a lever. The rack mount includes a top portion. The lever includes a handle portion, a hinge portion positioned at a fulcrum of the lever, and a support portion. The lever is hingeably coupled to the top portion of the rack mount.

In another exemplary embodiment, a dishwasher appliance is provided. The dishwasher appliance includes an adjustable rack assembly that includes a side wall. The adjustable rack assembly is transitionable between an upper position and a lower position. The dishwasher appliance also includes a bracket assembly attached to the side wall. The bracket assembly includes a rack mount and a lever. The rack mount includes a top portion. The lever is hingeably coupled to the rack mount at the top portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
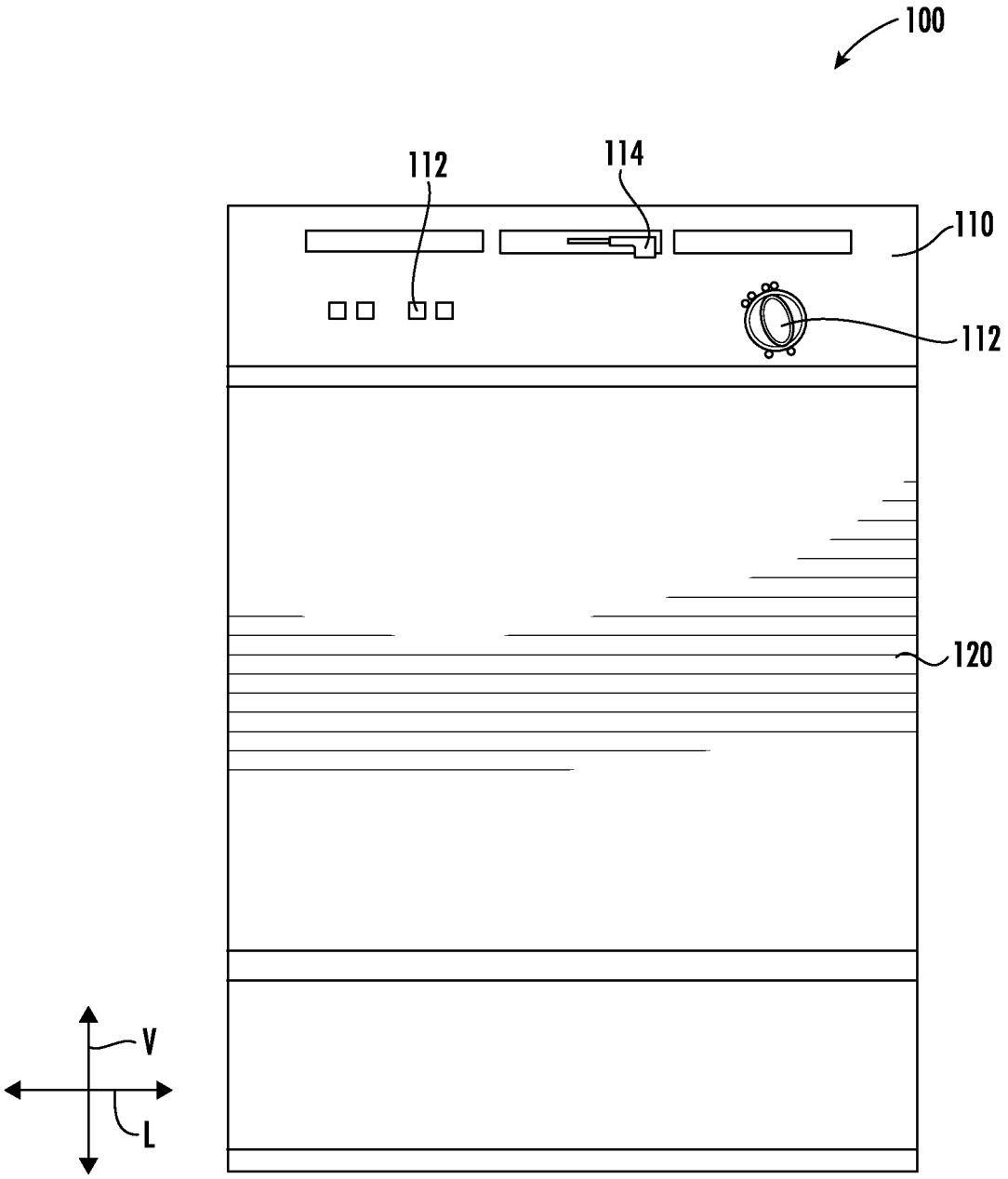
FIG. 1 provides a front elevation view of a dishwasher appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
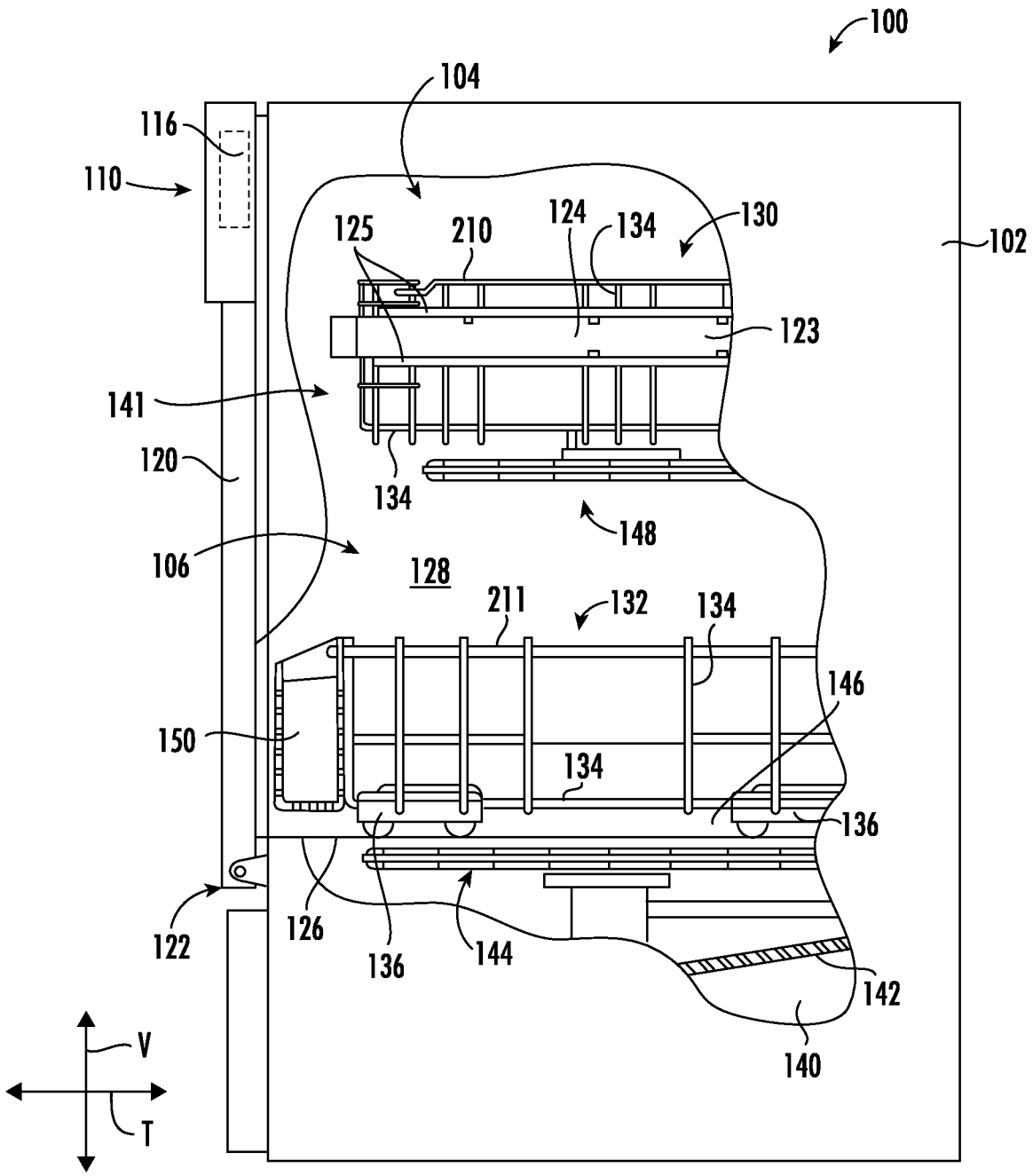
FIG. 2 provides a side, partially cut away view of the exemplary dishwasher appliance of FIG. 1.

Referring now to FIGS. 1 and 2, a dishwasher appliance 100 according to one or more exemplary embodiments of the present subject matter is provided. FIG. 1 provides a front elevation view of the dishwasher appliance 100 and FIG. 2 provides a side, partially cut away view of the dishwasher appliance 100 of FIG. 1. As depicted, the dishwasher appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwasher appliance 100 may include a cabinet 102 having a tub 104 therein that defines a wash chamber 106. The tub 104 may include a front opening and a door 120 that may be hinged at a bottom 122 for movement between a normally closed vertical position, e.g., FIGS. 1 and 2, wherein the wash chamber 106 is sealed shut for washing operation, and a horizontal open position (not depicted), wherein the loading and unloading of articles from the dishwasher appliance 100 may occur. In some instances, such as depicted in FIG. 1, the dishwasher appliance 100 may include a latch 114 that may be used to lock and unlock the door 120 such that access to the wash chamber 106 may be permitted or restricted.

In addition, the dishwasher appliance 100 may include one or more rack assemblies, such as an adjustable rack assembly 130 and a lower rack assembly 132, that may be used to load articles in the dishwasher appliance 100. In some instances, the adjustable rack assembly 130 may be referred to as an upper rack assembly 130 as it may be mounted within the dishwasher appliance 100 in an upper region 141 of the wash chamber 106, e.g., above the lower rack assembly 132 with respect to the vertical direction V. The rack assemblies 130, 132 may each be adapted for movement substantially along the transverse direction T between an extended loading position (not shown) in which the respective rack assembly 130, 132 is positioned substantially outside the wash chamber 106 and a retracted position, e.g., FIGS. 1 and 2, in which the respective rack assembly 130, 132 may be located entirely within the wash chamber 106. The movement of the adjustable rack assembly 130 may be facilitated by a pair of slide assemblies 124 that may be positioned at opposing lateral sides of the adjustable rack assembly 130. Additionally, the movement of the lower rack assembly 132 may be facilitated by a pair of roller assemblies 136 that may be positioned at opposing lateral sides of the lower rack assembly 132.

The rack assemblies 130, 132 may each include a dishrack for holding articles therein, e.g., for the cleaning of the articles. For instance, the adjustable rack assembly 130 may include an adjustable dishrack 210 and the lower rack assembly 132 may include a lower dishrack 211. The dishracks 210, 211 may each include a plurality of elongated member or rails 134 that may each be extended in the lateral direction L, the transverse direction T, and the vertical direction V. The plurality of rails 134 may be wires, rods, or any other suitable member, which may be fabricated into a lattice structure to form the shape of the respective dishrack 210, 211.

The pair of slide assemblies 124 may be any suitable pair of slide assemblies, for example, as depicted and described herein, the pair of slide assemblies 124 may be a pair of ball bearing slide assemblies 124 that each include an inner track 123 that may be mounted to, fixed to, or attached to, a lateral tub side wall 128 of the tub 104 and outer tracks 125 that may be attached to or mounted to a respective lateral side of the adjustable dishrack 210. Further, the outer tracks 125 may be slidably mounted onto the respective inner track 123 such that the outer tracks 125 may slide along the respective inner track 123, e.g., to move the adjustable rack assembly 130 between the extended loading position and the retracted position. In addition, lower guides 126 may be positioned in opposing manner of the sides of chamber 106 and provide a ridge or shelf for roller assemblies 136 so as to support and provide movement for the lower rack assembly 132.

Optionally, a silverware basket 150 may be removably attached to the lower rack assembly 132 for placement of silverware, small utensils, and the like, which are too small to be accommodated by the adjustable rack assembly 130 and the lower rack assembly 132.

Further, the dishwasher appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the adjustable rack assembly 130. In addition, the dishwasher appliance 100 may include a mid-level spray assembly 148 that may be located in the upper region 141 of the wash chamber 106 and may attached to, or located in close proximity to, the adjustable rack assembly 130, e.g., the mid-level spray assembly 148 may be in "close proximity" to the adjustable rack assembly 130 in that the mid-level spray assembly 148 is closer to the adjustable rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below the bottom sump portion 142 of the tub 104, as generally recognized in the art. Each spray assembly, e.g., lower spray assembly 144, mid-level spray assembly 148, and upper spray assembly, may include an arrangement of discharge ports or orifices for directing washing liquid onto dishes or other articles located in the adjustable rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwasher appliance 100 may further be equipped with a controller 116 to regulate operation of dishwasher appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 116 may be positioned in a variety of locations throughout dishwasher appliance 100. For example, as depicted in FIGS. 1 and 2, the controller 116 may be located within a control panel area 110 of the door 120. In such an embodiment, input/output ("I/O") signals may be routed between the control system and various operational components of dishwasher appliance 100 along wiring harnesses that may be routed through bottom 122 of door 120. In certain embodiments, the control panel area 110 may include input components 112 through which a user may select various operational features and modes and monitor progress of the dishwasher appliance 100. For instance, in some embodiments, input components 112 may be a variety of electrical, mechanical or electro-mechanical input devices including rotary dials (e.g., FIG. 1), push buttons (e.g., FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 are for illustrative purposes only. For example, different locations may be provided for the input components 112, different configurations may be provided for the adjustable rack assembly 130 and the lower rack assembly 132, and other differences may be applied as well.

Figure 3:
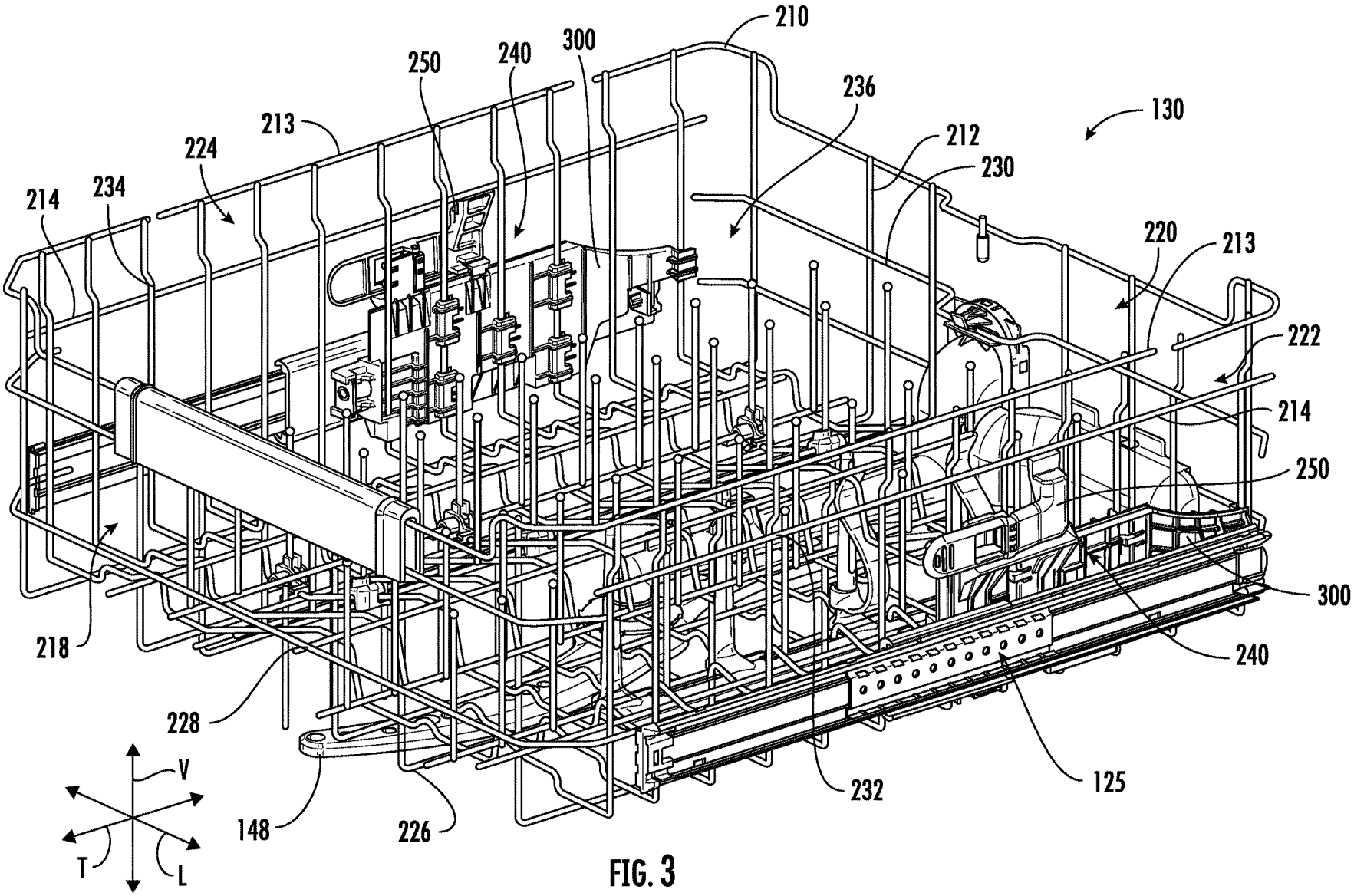
FIG. 3 provides a perspective view of an adjustable rack assembly in an upper position according to one or more exemplary embodiments of the present subject matter.
Figure 4:
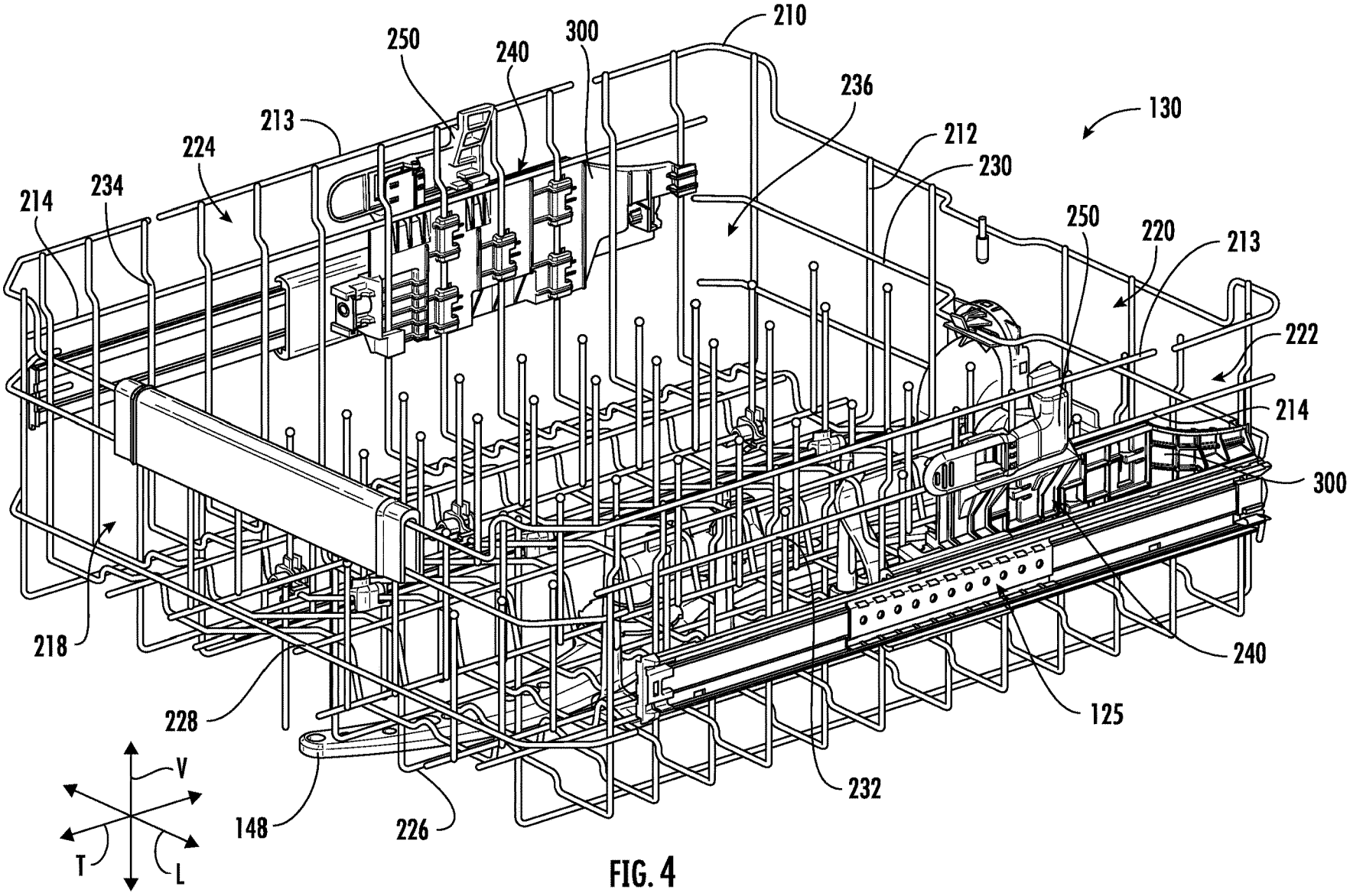
FIG. 4 provides a perspective view of an adjustable rack assembly in a lower position according to one or more exemplary embodiments of the present subject matter.
Figure 5:
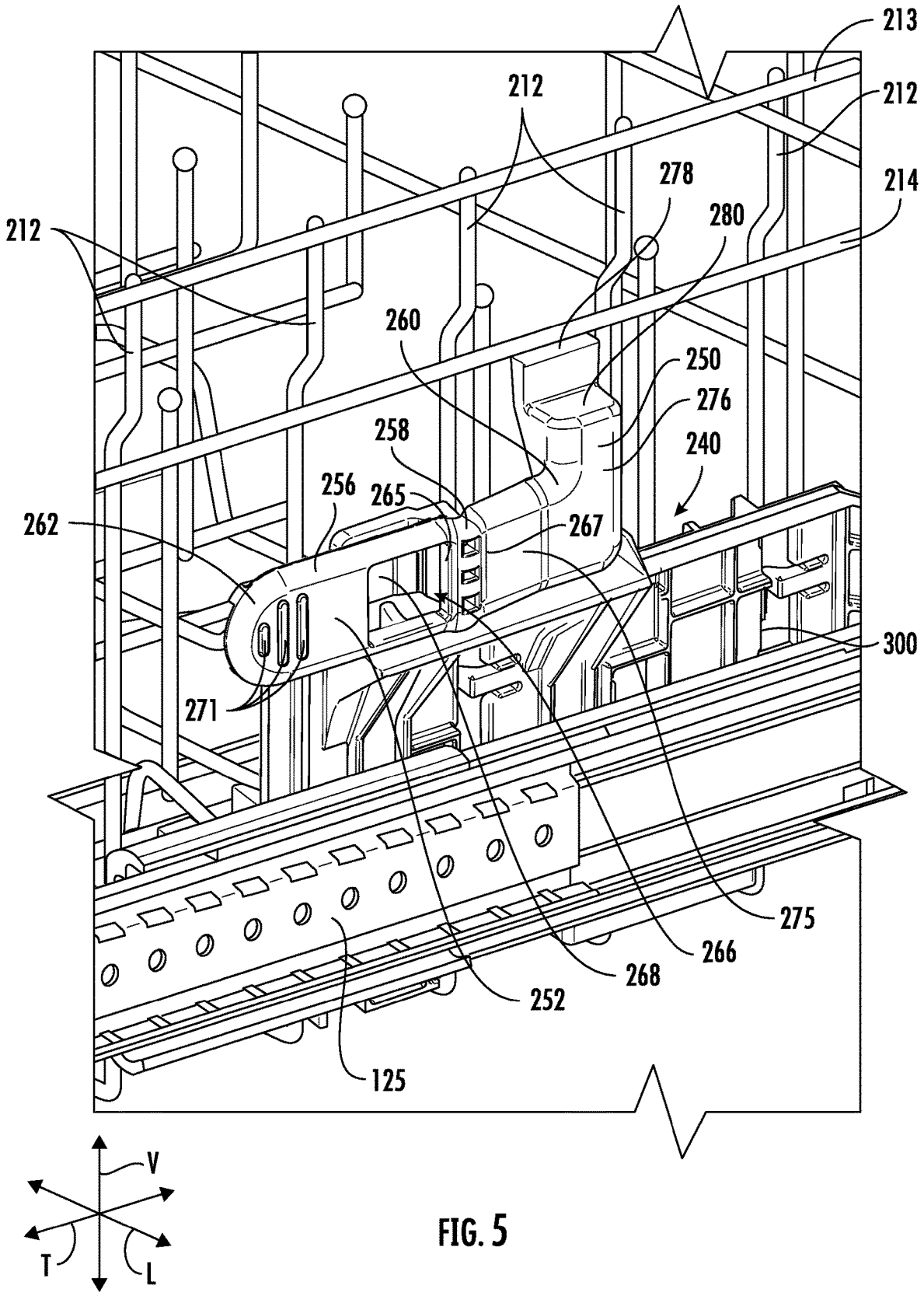
FIG. 5 provides a close-up perspective view of the exemplary adjustable rack assembly of FIG. 3.

Referring now to FIGS. 3 and 4, perspective views of the adjustable rack assembly 130 according to one or more exemplary embodiments of the present subject matter are provided. Specifically, FIG. 3 depicts the adjustable rack assembly 130 in an upper position and FIG. 4 provides the adjustable rack assembly 130 in a lower position. Moreover, the vertical direction V, the lateral direction L, and the transverse direction T described herein, with respect to the various elements of the adjustable rack assembly 130 are, except as otherwise indicated, generally understood to correspond to the position of those elements when adjustable rack assembly 130 may be mounted within wash chamber 106 and to the rest of dishwasher appliance 100, e.g., such that the adjustable dishrack 210 may slide along the slide assembly 124 substantially in or along the transverse direction T.

The adjustable rack assembly 130 may extend transversely, e.g., approximately along or approximately parallel to the transverse direction T, between a front end portion 218 and a back end portion 220, and may extend laterally, e.g., approximately along or approximately parallel to the lateral direction L, between a first side portion 222 and a second side portion 224. Furthermore, the adjustable dishrack 210 may include a bottom wall 226, a front wall 228 that may extend vertically upward from the bottom wall 226 at the front end portion 228, a back wall 230 that may extend vertically upward from the bottom wall 226 at the back end portion 220, a first side wall 232 that may extend vertically upward from the bottom wall 226 at the first side portion 222, and a second side wall 234 that may extend vertically upward from the bottom wall 226 at the second side portion 224. The bottom wall 226, the front wall 228, the back wall 230, the first side wall 232, and the second side wall 234 may together define a rack cavity 236 of the adjustable dishrack 210 that may be configured for the receipt of articles, e.g., pots, pans, cups, etc., therein. In addition, the first side wall 232 and the second side wall 234 may each include a plurality of vertical rails 212, an upper transverse rail 213, and a support transverse rail 214.

Further, the adjustable rack assembly 130 may include a pair of bracket assemblies 240 that each may be provided on, e.g., attached to, the first side wall 232 and the second side wall 234, respectively. As will be appreciated, the adjustment and/or the movement of the adjustable rack assembly 130 between different predetermined positions, e.g., vertical heights, such as the upper position, e.g., FIG. 3, and the lower position, e.g., FIG. 4, may be permitted by the pair of bracket assemblies 240.

Figure 6:
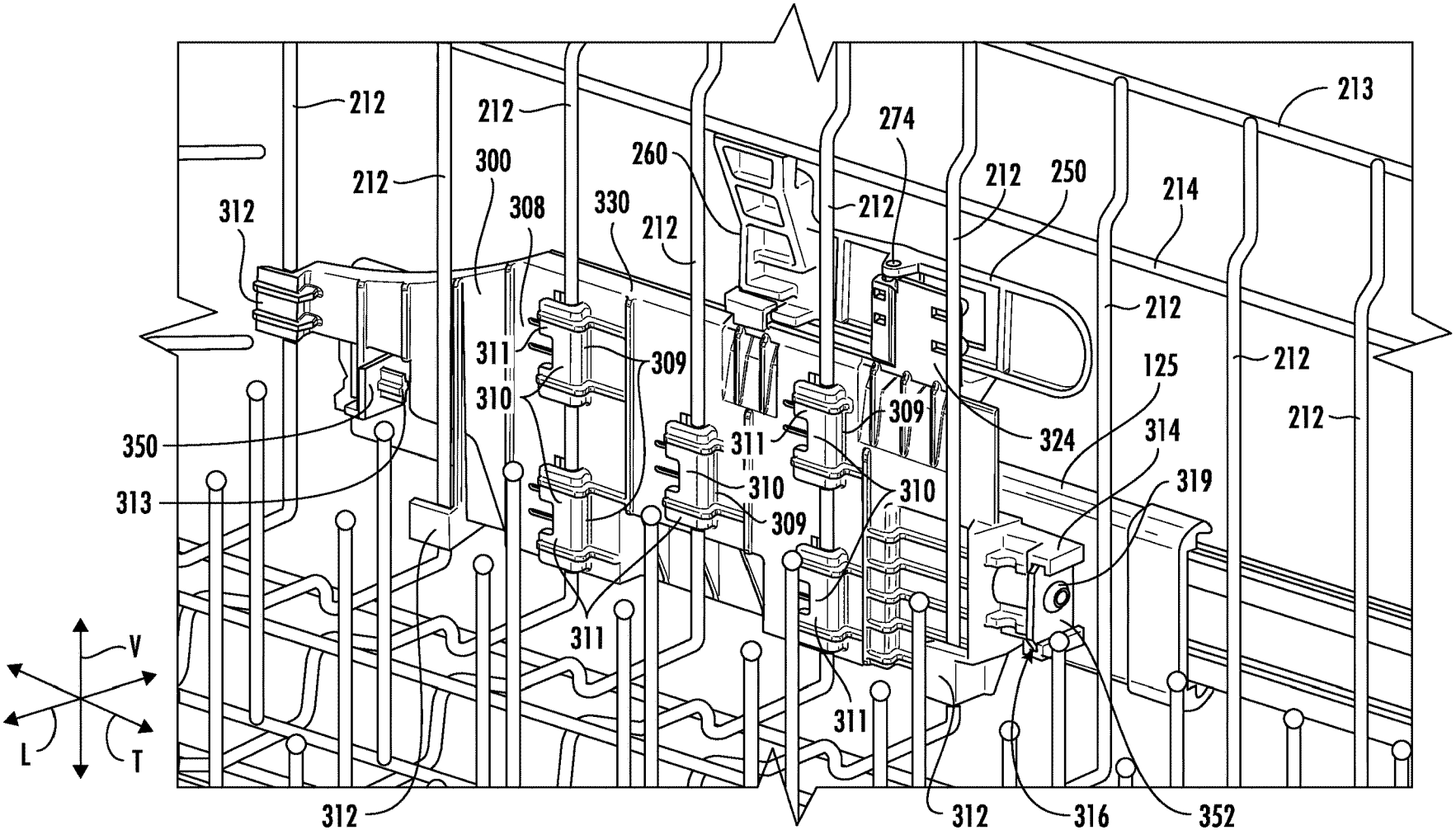
FIG. 6 provides a close-up, perspective view of the exemplary adjustable rack assembly of FIG. 3.
Figure 7:
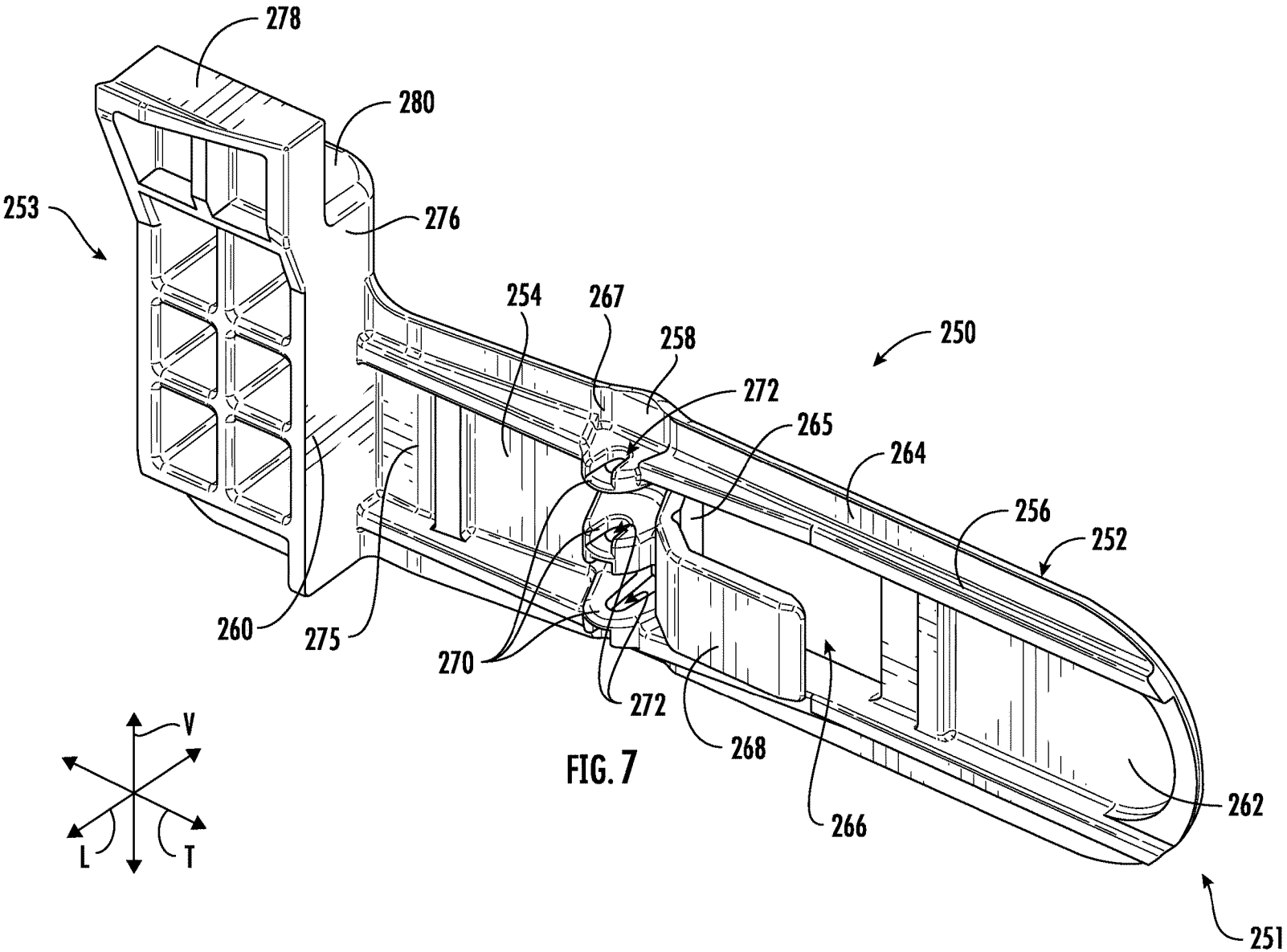
FIG. 7 provides a perspective view of a lever of a bracket assembly according to one or more exemplary embodiments of the present subject matter.
Figure 8:
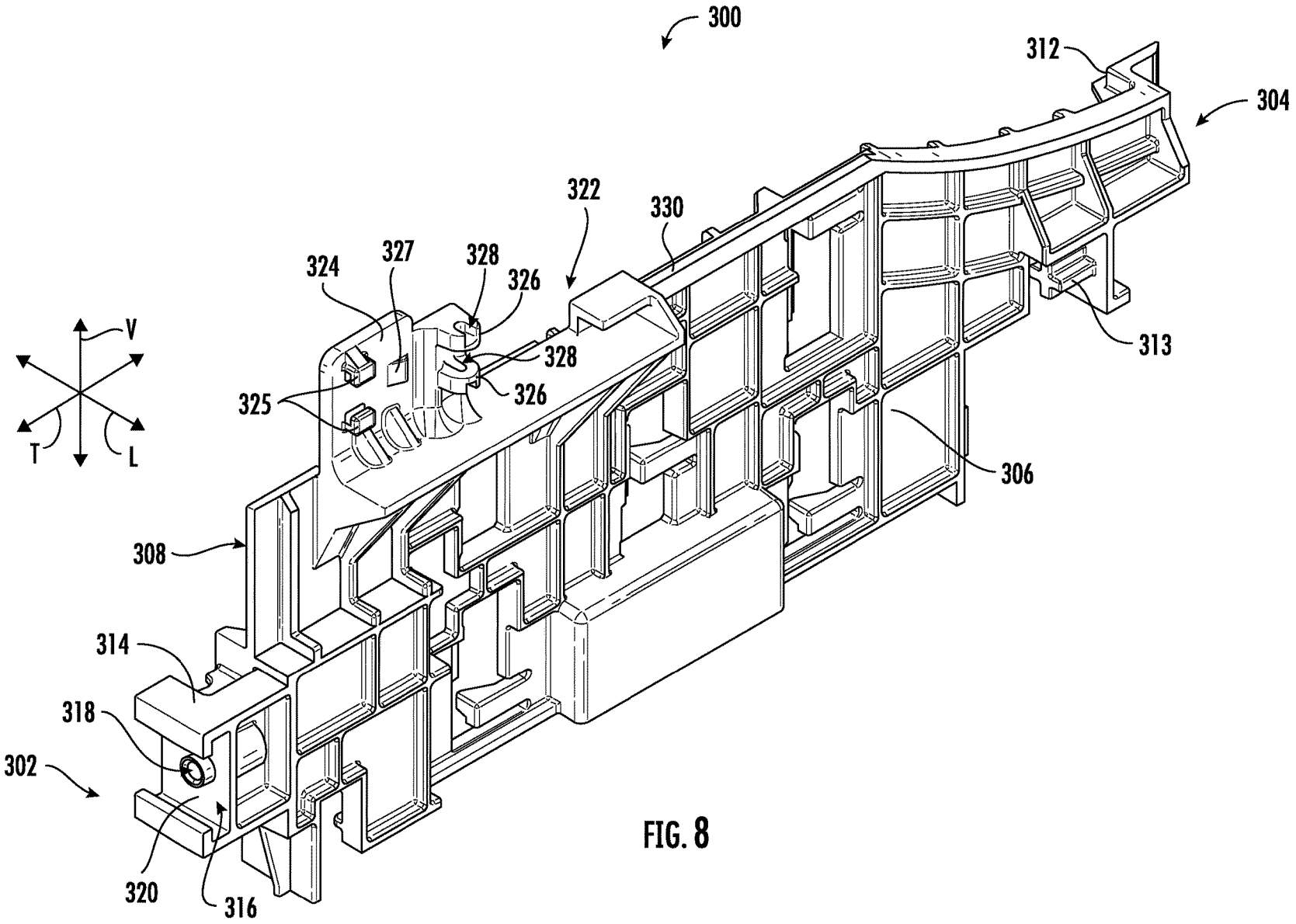
FIG. 8 provides a perspective view of a rack mount of a bracket assembly according to one or more exemplary embodiments of the present subject matter.

Referring now to FIGS. 5 through 8, perspective views of a bracket assembly 240 and components thereof according to one or more exemplary embodiments of the present subject matter are provided. Specifically, FIGS. 5 and 6 each provide a perspective view of a bracket assembly 240 attached to the first side wall 232 of the adjustable dishrack 210, FIG. 7 provides a perspective view of a lever 250 of a bracket assembly 240, and FIG. 8 provides a perspective view of a rack mount 300 of a bracket assembly 240.

For the purposes of clarity, only a discrete bracket assembly 240 and components thereof, are generally described herein. Nonetheless, it is understood that an identical bracket assembly may mirror the discrete bracket assembly 240 described herein. For instance, as depicted in FIGS. 3 and 4, a bracket assembly 240 may be attached to the first side wall 232 and may be identical to and/or mirror the structure and function of the bracket assembly 240 attached to the second side wall 222.

The lever 250 of the bracket assembly 240 may extend transversely, e.g., approximately along or approximately parallel to the transverse direction T, between a front lever end 251 and a back lever end 253. In addition, the lever 250 may include an outer face 252, e.g., the laterally outward facing surface or side of the lever 250. For instance, when the bracket assembly 240 may be attached to the adjustable rack assembly 130, the outer face 252 may face toward the tub side wall 128. Further, the lever 250 may include an inner face 254, e.g., the laterally inward facing side or surface of the lever 250. For instance, when the bracket assembly 240 may be attached to the adjustable rack assembly 130, the inner face 254 may face the rack cavity 236, and more particularly may face the respective lateral side wall, e.g., the first side wall 232 or the second side wall 222, of the adjustable rack assembly 130 to which the bracket assembly 240 is mounted.

Furthermore, the lever 250 may include a handle portion 256 positioned proximate to the front lever end 251. For instance, the handle portion 256 may be positioned closer to the front lever end 251 than the back lever end 253, such as positioned at the front lever end 251 or positioned in front of, e.g., with respect to the transverse direction T, a fulcrum, e.g., the pivot point, of the lever 250. In addition, the lever 250 may include a hinge portion 258 positioned proximate to the fulcrum of the lever 250. For instance, the hinge portion 258 may be positioned within the middle fifty percent of the transverse length of the lever 250, such as at the fulcrum of the lever 250. Further, the lever 250 may include a support portion 260 that may be positioned proximate the back lever end 253. For instance, the support portion 260 may be positioned closer to the back lever end 253 than the front lever end 251, such as positioned at the back lever end 253 or positioned behind, e.g., with respect to the transverse direction T, the fulcrum of the lever. In addition, the handle portion 256 may be connected to the hinge portion 258 at a first junction 265 and the hinge portion 256 may be connected to the support portion 260 at a second junction 267.

The handle portion 256 may include an elliptically shaped head 262 and an arm 264 that may extend transversely, e.g., approximately along or approximately parallel to the transverse direction T, from the head 262 toward the back lever end 253. One or more tactile indicators 271 (FIG. 5) may be provided on the outer face 252 of the lever 250, and more particularly, on the outer face 252 of the handle portion 256. The one or more tactile indicators 271 may provide a physical indicator for locating the lever 250. For example, in some instance, the lever 250 may not be entirely visible, e.g., to a user of the dishwasher appliance 100, when viewed from the front of the dishwasher appliance 100. In such instances, the tactile indicators 271 may provide a physical bump, ridge, or protrusion that may assist a user in locating the handle portion 256.

The arm 264 may include a spring slot 266 defined therethrough and a spring 268 that may be positioned at or proximate to the first junction 265. The spring 268 may extend from the inner face 254 of the lever 250 and may include a bend that further transversely extends the spring 268 toward the front lever end 251. In some instances, such as depicted in FIG. 7, the bend of the spring 268 may be a gradual bend of approximately ninety degrees. In addition, the spring 268 may be configured to deflect, such as when the lever 250 may be pivoted between a locked position, wherein the adjustable dishrack 210 may be locked, e.g., at a respective vertical position, such as the upper position, and an unlocked position, wherein the adjustable dishrack 210 may be permitted to transition from one vertical position to another vertical position, e.g., from the upper position to the lower position under the force of gravity. Further, the spring slot 266 may be configured to accommodate the deflection of the spring 268 by providing an opening for the spring 268 to at least partially pass through, such as when the spring 268 may be deflected.

The hinge portion 258 may include a plurality of lever knuckles 270 that may be stacked vertically along the inner face 254 of the lever 250. Each lever knuckle 270 may include a lever pin hole 272 that may be defined through the respective lever knuckle 270. The lever pin holes 272 may each be concentrically aligned with the adjacent hole(s) and may be configured to receive a pin 274. As will be described in more detail below, the lever knuckles 270 may be interdigitated with corresponding features of the rack mount 300 to form a hinge, e.g., an articulation point, for the lever 250 to pivot about.

The support portion 260 of the lever 250 may include a support arm 275 that may extend approximately along or approximately parallel to the transverse direction T, from the second junction 267 to a support pedestal 276 that may be extend upward, e.g., approximately along or approximately parallel to the vertical direction V, from the support arm 275. Further, the support pedestal 276 may include a first support surface 278 and a second support surface 280 that may be positioned in a two-tiered configuration. For instance, the second support surface 280 may be positioned lower, e.g., substantially along the vertical direction V, than the first support surface 278 and may be offset, e.g., with respect to the lateral direction L, from the first support surface 278. As such, the second support surface 280 may be referred to as a lower support surface 280, and the first support surface 278 may be referred to as an upper support surface 278.

Furthermore, the rack mount 300 of the bracket assembly 240 may extend transversely, e.g., approximately along or approximately parallel to the transverse direction T, from a first bracket end 302 to a second bracket end 304. The rack mount 300 may include a first side 306, e.g., the laterally outward facing side of the rack mount 300 and a second side 308, e.g., the laterally inward facing side of the rack mount 300. In addition, the rack mount 300 may include one or more snap joints 310 (FIG. 6) that may each be positioned at the second side 308 of the rack mount 300.

Each snap joint 310 may include a first surface 309 that may extend laterally, e.g., approximately along or approximately parallel to the lateral direction L, from the second side 308 of the rack mount 300. Further, each snap joint 310 may include a second surface 311 (FIG. 6) that may extend transversely, e.g., approximately along or approximately parallel to the transverse direction T, from the first surface 309 toward the second bracket end 304. Further, each snap joint 310 may be attached to a respective vertical rail 212 of the first side wall 232, e.g., to mount the rack mount 300 to the first side wall 232. In addition, when attached to a respective vertical rail 212, each snap joint 310 may provide a clearance fit for the respective vertical rail 212, wherein "clearance fit" may refer to the fit between, or the mating of, a snap joint 310 and a vertical rail 212 that may include a gap or space between the snap joint 310 and the vertical rail 212. The gap or space between the snap joint 310 and the vertical rail 212 may be configured to permit vertical movement of the adjustable rack assembly 130, e.g., by providing space for the vertical rails 212 to move up and down within the respective snap joint(s) 310, e.g., substantially along the vertical direction V.

As depicted in FIG. 6, the rack mount 300 may include five snap joints 310 that are arranged in a two-one-two formation. For instance, the rack mount 300 may include a first set that may include two vertically stacked snap joints 310, a second set that may include a discrete snap joint 310, e.g., only a single snap joint 310, and a third set that may include two vertically stacked snap joints 310. The first set of snap joints 310 may be positioned proximate the second bracket end 304, e.g., closer to the second bracket end 304 than the second set and the third set, and may be attached to a discrete vertical rail 212. Further, the second set may be positioned proximate the center of the rack mount 300, e.g., closer to the center of the rack mount 300 than the first set and the third set, and the single snap joint 310 of the second set may be attached to another discrete vertical rail 212. In addition, the third set may be positioned proximate the first bracket end 302, e.g., closer to the first bracket end than the first set and the second set, and the snap joint(s) 310 of the third set, e.g., both snap joints 310 of the third set as in the illustrated exemplary embodiment, may be attached to yet another discrete vertical rail 212.

As will be understood by those skilled in the art, the number and formation of snap joints 310 depicted is provided by way of example only. In additional embodiments, any suitable number or formation of snap joints 310 may be provided at the second side 308 of the rack mount 300, such as five snap joints 310 in a two-two-one formation, etc. For example, in some embodiments, only two snap joints 310 may be provided, or more than five snap joints 310 may be provided, such as six or more snap joints 310 may be provided.

In addition, the rack mount 300 may include one or more rail guides 312 (FIG. 6) that may extend from the second side 308 of the rack mount 300. Particularly, the rail guides 312 may extend from the second side 308 of the rack mount 300 at various location and may include a bend, such as an approximately ninety degree bend, which may hook around a discrete vertical rail 212 to mitigate movement of the respective vertical rail 212, e.g., with respect to the transverse direction T and the lateral direction L.

As will be understood by those skilled in the art, the number of rail guides 312 depicted is provided by way of example only. In additional embodiments, any suitable number of rail guides 312 may be provided. For example, in some embodiments, only two rail guides 312 may be provided, or more than three rail guides 312 may be provided, such as four or more rail guides 312 may be provided.

Further, the rack mount 300 may include features for locating and attaching the outer track 125 of the slide assembly 124 to the rack mount 300. For instance, the rack mount 300 may include a rail locator pin 313 that may be positioned at or proximate the second bracket end 304 and may extend transversely, e.g., approximately along or approximately parallel to the transverse direction T, toward the first bracket end 302. The outer track 125 may be located to the rack mount 300 by passing the rail locator pin 313 through a locating slot defined through a corresponding locator bracket 350 of the outer track 125. In addition, the outer track 125 may be attached to the rack mount 300 at a rail mount 314 that may be positioned at or proximate to the first bracket end 302. The rail mount 314 may define a bracket channel 316, such as a U-shaped bracket channel 316, that may receive a mount bracket 352 of the outer track 125. The rail mount 314 may include a screw hole 318 that may be extended through a flat lateral surface 320 of the rail mount 314. The screw hole 318 may be configured to receive a fastener 319, e.g., a screw, bolt, or rivet, which may fasten and secure mount bracket 352 to the rail mount 314.

Further, the rack mount 300 may include a top portion 322 located at, or proximate to, the top of the rack mount 300, e.g., with respect to the vertical direction V. The top portion 322 of the rack mount 300 may include a locking tray 324 and a rail support surface 330. The locking tray 324 may include one or more mount knuckles 326 that each include a mount pin hole 328 defined therethrough. In addition, the locking tray 324 may include a pair of locking tabs 325 that together may hold the spring 268 of the lever 250 and a deflection tab 327 that the spring 268 may rest on.

In some embodiments, the lever 250 may be mounted to, e.g., attached to, the top portion 322 of the rack mount 300. Mounting the lever 250 to the top portion 322 of the rack mount 300 may vertically separate the lever 250 from the rest of the rack mount 300 and may make the lever 250 clearly visible, e.g., to a user of the dishwasher appliance 100, such as when the user may be viewing the dishwasher appliance 100 from the front. In addition, in some embodiments, the one or more lever knuckles 270 of the lever 250 may be interdigitated with the one or more mount knuckles 326 of the rack mount 300 to concentrically align the lever pin holes 272 and the mount pins holes 328 so that a pin 274 may be passed through, e.g., as illustrated in FIG. 6. The interdigitation of the knuckles 270, 326 and the pin 274 may create a hinge at the fulcrum of the lever 250 and the lever 250 may be hingeable coupled to the rack mount 300 and may be configured to be pivoted at the hinge.

In some cases, a user may wish to adjust the adjustable rack assembly 130 from the upper position, e.g., FIG. 3, to the lower position, e.g., FIG. 4. Such an adjustment may allow for larger items, e.g., taller items, to be placed in the adjustable rack assembly 130. For instance, in the lower position, the adjustable rack assembly 130 may generally be positioned lower, e.g., with respect to the vertical direction V, within the dishwasher appliance 100. For instance, in the lower position, the adjustable rack assembly 130 may be positioned further away from a ceiling of the tub 104 and/or further away from an upper spray assembly that may be provided above the adjustable rack assembly 130, e.g., when compared to the distance between the adjustable rack assembly 130 and the ceiling of the tub 104 when the adjustable rack assembly 130 is in the upper position. The lower vertical position of the adjustable rack assembly 130 may increase the vertical space of the rack cavity 236, such that larger items may properly fit within the adjustable rack assembly 130.

Conversely, in some cases, a user may wish to adjust the adjustable rack assembly 130 from the lower position, e.g., FIG. 4, to the upper position, e.g., FIG. 3. Such an adjustment may allow for larger items, e.g., taller items, to be placed in the lower rack assembly 132. In the upper position, the adjustable rack assembly 130 may be positioned higher, e.g., with respect to the vertical direction V, within the dishwasher appliance 100, and farther away from, e.g., above, the lower rack assembly 132. The higher vertical position of the adjustable rack assembly 130 may increase the vertical space of a cavity defined by the lower rack assembly 132, such that larger items may properly fit within the lower rack assembly 132.

In some embodiments, the lever 250 may be pivoted between a locked position and an unlocked position. In the locked position, the lever 250 may lock, e.g., inhibit vertical movement, of the adjustable rack assembly 130, and more particularly, the adjustable dishrack 210 from the upper position to the lower position. For example, e.g., as depicted in FIG. 3, the adjustable dishrack 210 may be in the upper position and the lever 250 may be in the locked position. The lever 250 and a side wall, e.g., the first side wall 232 or the second side wall 234, of the adjustable dishrack 210 may be interfaced, and the weight of the adjustable dishrack 210 may be supported by the lever 250 at the side wall. More specifically, the first support surface 278 of the lever 250 and the support transverse rail 214 of the adjustable dishrack 210 may be interfaced when the adjustable rack assembly 130 is in the upper position, and the weight of the adjustable dishrack 210 may be supported by the first support surface 278 at the support transverse rail 214.

To permit movement of the adjustable dishrack 210 from the upper position to the lower position, the lever 250 may be pivoted from the locked position to the unlocked position, wherein the lever 250 is cleared from the adjustable dishrack 210 and does not support the weight of the adjustable dishrack 210. To pivot the lever 250 from the locked position to the unlocked position, a laterally inward force may be applied to the handle portion 256 of the lever 250. The lever 250 may be pivoted about its fulcrum, the support portion 260 of the lever 250 may be cleared from the respective side wall, and more particularly from the respective transverse support rail 214, of the adjustable dishrack 210. Moreover, the laterally inward force that may be applied to the handle portion 256 of the lever 250, e.g., to pivot the lever 250 from the locked position to the unlocked position, may compress the spring 268 relative to the locking tray 324, e.g., as the spring 268 may be held in place by the locking tabs 325. For example, a user of the dishwasher appliance 100 may apply a laterally inward force, such as a pinch, to the respective handle portions 256 of each lever 250. The laterally inward force applied to the levers 250 may pivot each lever 250 about its fulcrum and may move the support portions 260 of the levers 250 laterally outward, e.g., to clear the levers 250 from the support transverse rails 214 of the respective lateral side walls. The adjustable dishrack 210 may then be permitted to move downward, e.g., slide down such as translate downward approximately along the vertical direction V under the force of gravity, and thereby transition to the lower position, e.g., FIG. 4.

Furthermore, when the adjustable rack assembly 130 may be in, or may be approaching the lower position, the compression held within the spring 268 may bias or urge the lever 250 to the locked position, such as when the laterally inward force is removed from the handle portion 256, e.g., when a user of the dishwasher appliance 100 releases the handle portion 256. Thus, lever 250 may be biased to the locked position by the spring 268.

In the lower position, the rack mount 300 and the side wall, e.g., the first side wall 232 or the second side wall 234, of the adjustable dishrack 210 may be interfaced, and the weight of the adjustable dishrack 210 may be supported by the rack mount 300 at the side wall, e.g., the first side wall 232 or the second side wall 234. More specifically, the rail support surface 330 of the rack mount 300 and the support transverse rail 214 of the adjustable dishrack 210 may be interfaced, and the weight of the adjustable dishrack 210 may be supported by the rail support surface 330 at the support transverse rail 214. In addition, in some embodiments, the support pedestal 276 of the lever 250 may be interfaced with the upper transverse rail 213 of the adjustable dishrack 210 in the lower position. In particular, in some embodiments, e.g., FIG. 4, the upper transverse rail 213 may be interfaced with the second support surface 280 and the adjoining vertical surface, e.g., the adjoining vertical surface that may form the second tier of the support pedestal 276, such that lateral movement, e.g., movement approximately along or approximately parallel to the lateral direction L, of the adjustable dishrack 210 may be mitigated.

To move the adjustable rack assembly 130 from the lower position to the upper position, the adjustable dishrack 210 may be moved vertically upward, e.g., by lifting the adjustable dishrack 210. For example, a user of the dishwasher appliance 100 may lift the adjustable dishrack 210 upward along the vertical direction V such that the adjustable rack assembly 130 may be placed in the lower position. As briefly mentioned above, due to the clearance fit between the vertical rails 212 and the snap joints 310 of the rack mounts 300, the adjustable dishrack 210 may move freely, with respect to the vertical direction V, along the vertical rails 212 of the adjustable dishrack 210 without actuating the lever 250, e.g., without pivoting the lever 250 about its fulcrum.

For instance, as the adjustable dishrack 210 may be raised from the lower position to the upper position, the lever 250, and more particularly the support portion 260, may be deflected laterally outward, e.g., substantially along the lateral direction L, as the relatively rigid support transverse rail 214, e.g., rigid when compared to the pivotable lever 250, may contact the support portion 260 and pivot the lever 250 about its fulcrum. As the support transverse rail 214 passes along the support portion 260 and deflects the support portion 260, the spring 268 may be compressed. Further, as the support portion 260 may be cleared from the support transverse rail 214, e.g., the support portion 260, and more particularly, the first support surface 278 may be vertically lower than the support transverse rail 214, the spring 268 may decompress and urge the lever 250 to the locked position, e.g., as the lever 250 may be biased toward the locked position by the spring 268.

Embodiments of the dishwasher appliance 100 provided herein may advantageously improve the usability and the assembly of the adjustable rack assembly 130. For instance, but without limitation, by placing the adjustable mechanisms, e.g., the levers 250, of the bracket assemblies 240 at the top portion 322 of the rack mount 300, the visibility of the lever 250, e.g., as viewed from the front by a user of the dishwasher appliance, may be improved. As such, the usability of the adjustable rack assembly 130 may be improved. In addition, the simplified bracket assemblies may improve the assembly process of the dishwasher appliance 100 as the two piece construction of the bracket assemblies, e.g., the combination of the lever 250 and the rack mount 300, may reduce the part count of the bracket assembly, e.g., when compared to traditional bracket assemblies which may typically include two or more parts in the rack mount.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a tub defining a wash chamber;

a slide assembly comprising an inner track and an outer track, the outer track comprising a locator bracket and a mount bracket; and an adjustable rack assembly mounted within the tub, wherein the adjustable rack assembly is transitionable between one or more predetermined positions along the vertical direction, the adjustable rack assembly comprising:

a dishrack comprising a side wall; and a bracket assembly attached to the side wall, the bracket assembly comprising rack mount and a lever, the rack mount comprising a top portion, a locator pin, and a bracket channel, the lever comprising a handle portion, a hinge portion positioned at a fulcrum of the lever, and a support portion, wherein the lever is hingeably coupled to the top portion of the rack mount, wherein the rack mount is directly attached to the outer track of the slide assembly, wherein the locator bracket is located to the rack mount at the locator pin, and wherein the mount bracket is attached to the rack mount at the bracket channel.

2. The dishwasher appliance of claim 1, wherein the side wall of the dishrack comprises a plurality of vertical rails, wherein the rack mount comprises one or more snap joints, and wherein each snap joint is attached to a respective vertical rail.

3. The dishwasher appliance of claim 1, wherein the tub further comprising a tub side wall, wherein the inner track of the slide assembly is fixed to the tub side wall, and wherein the outer track is slidably attached to the inner track and configured to transition the adjustable rack assembly substantially along the transverse direction between an extended loading position and a retracted position.

4. The dishwasher appliance of claim 1, wherein the rack mount comprises a locking tray positioned at the top portion of the rack mount, wherein the lever is hingeably coupled to the rack mount at the locking tray.

5. The dishwasher appliance of claim 4, wherein the lever comprises a spring, wherein the locking tray comprises pair of locking tabs, and wherein the spring is held by the pair of locking tabs.

6. The dishwasher appliance of claim 1, wherein the one or more predetermined positions comprises an upper position and a lower position, wherein the dishrack is supported at a first vertical height by the lever in the upper position, and wherein the dishrack is supported at a second vertical height by the rack mount in the lower position.

7. The dishwasher appliance of claim 6, wherein the lever is transitionable between a locked position and an unlocked position, wherein the dishrack is locked in the upper position in the locked position, and wherein the dishrack is permitted to transition from the upper position to the lower position in the unlocked position.

8. The dishwasher appliance of claim 6, wherein the support portion comprises a first support surface and a second support surface, wherein the first support surface and the side wall are interfaced in the upper position, and wherein the side wall is supported by the first support surface in the upper position.

9. The dishwasher appliance of claim 6, wherein the rack mount comprises a rail support surface and wherein the side wall is supported by the rail support surface in the lower position.

10. The dishwasher appliance of claim 1, wherein the side wall of the dishrack is a first side wall, wherein the dishrack further comprises a second side wall that is laterally opposed to the first side wall, wherein the bracket assembly is a first bracket assembly attached to the first side wall, and wherein the dishwasher appliance further comprises a second bracket assembly attached to the second side wall.

11. A dishwasher appliance comprising:

an adjustable rack assembly comprising a side wall, wherein the adjustable rack assembly is transitionable between an upper position and a lower position; and a bracket assembly attached to the side wall, the bracket assembly comprising a rack mount and a lever, the rack mount comprising a top portion and a locking tray positioned at the top portion of the rack mount, the locking tray comprising a pair of locking tab, the lever comprising a spring, wherein the lever is hingeably coupled to the rack mount at the locking tray, and wherein the spring is held by the pair of locking tabs.

12. The dishwasher appliance of claim 11, wherein the side wall of the adjustable rack assembly comprises a plurality of rails, wherein the rack mount comprises one or more snap joints, and wherein each snap joint is attached to a respective rail of the plurality of rails.

13. The dishwasher appliance of claim 11, further comprising:

a slide assembly comprising an inner track and an outer track, wherein the outer track is directly attached to the rack mount, and wherein the outer track is slidably attached to the inner track and configured to transition the adjustable rack assembly between an extended loading position and a retracted position.

14. The dishwasher appliance of claim 13, wherein the rack mount comprises a locator pin and bracket channel, wherein the outer track comprises a locator bracket and a mount bracket, and wherein the locator bracket is located to the rack mount at the locator pin, and wherein the mount bracket is attached to the rack mount at the bracket channel.

15. The dishwasher appliance of claim 11, wherein the lever is transitionable between a locked position and an unlocked position, wherein the adjustable rack assembly is locked in the upper position in the locked position, and wherein the adjustable rack assembly is permitted to transition from the upper position to the lower position in the unlocked position.

16. The dishwasher appliance of claim 11, wherein the lever comprises a support portion, wherein the support portion comprises a first support surface and a second support surface, wherein the first support surface and the side wall are interfaced in the upper position, and wherein the side wall is supported by the first support surface in the upper position.

17. The dishwasher appliance of claim 16, wherein the rack mount comprises a rail support surface and wherein the side wall is supported by the rail support surface in the lower position.

* * * * *